United States Patent [19]

Steffanus

[11] Patent Number: 4,773,887

[45] Date of Patent: Sep. 27, 1988

[54] RESCUE APPARATUS FOR SMALL BOATS

[76] Inventor: Eugene T. Steffanus, 7 Suffolk Dr., Coraopolis, Pa. 15108

[21] Appl. No.: 107,391

[22] Filed: Oct. 8, 1987

[51] Int. Cl.[4] ..... B63C 9/00

[52] U.S. Cl. ..... 441/80; 114/362

[58] Field of Search ..... 441/80; 114/362, 210, 114/368, 375, 365; 414/138

[56] References Cited

U.S. PATENT DOCUMENTS

| | | | |
|---|---|---|---|
| 1,475,290 | 11/1923 | Ellison et al. . | |
| 3,303,945 | 2/1967 | Hubbard et al. . | |
| 3,363,269 | 1/1968 | Kossuth . | |
| 3,370,310 | 2/1968 | La Tour . | |
| 3,993,011 | 11/1976 | Garland | 114/210 |
| 4,610,635 | 9/1986 | Austevoll | 441/80 |

*Primary Examiner*—Sherman D. Basinger
*Attorney, Agent, or Firm*—Richard V. Westerhoff

[57] ABSTRACT

A rescue device for small boats includes a rescue basket of open lattice work having a bottom wall with a high side wall inboard and a raised edge outboard. Rollers mounted to the side wall engage guide rails extending downward along the hull of the boat. A winch and cable system raise the basket from a submerged position in which the victim can be easily maneuvered into the basket utilizing the buoyancy of the water, and a raised position in which upward travel of the rollers is limited by detents in the guide rails. Continued operation of the winch causes the basket to pivot around the rollers bringing side wall into a horizontal position generally level with the top edge of the boat. The victim is rolled onto the side wall where aid may be administered during transport to the land or the victim can be easily brought completely into the boat. In this pivoted position, the bottom wall of the basket is substantially vertical so that the victim can not roll overboard. A latch mechanism locks the rollers in the detents and the bottom wall of the basket may be cinched against braces by the winch to form a stable platform for transport of the victim to land.

14 Claims, 4 Drawing Sheets

RESCUE APPARATUS FOR SMALL BOATS

BACKGROUND OF INVENTION

1. Field of the Invention

This invention is directed to apparatus mountable on a small boat for rescuing persons from the water, especially unconscious or otherwise incapacitated persons.

2. Background Information

Rescuing persons from the water using small boats is difficult, especially when the victim is incapacitated and hence unable to assist in the rescue. Even a small person is difficult to bring aboard if unconscious. Often the difference between life and death or permanent injury is a matter of minutes, therefore, it is important to recover the person from the water quickly so that aid can be administered.

Devices for rescuing persons from the water with small boats have been disclosed in U.S. Pat. Nos. 3,363,269 and 3,370,310. The device disclosed in the former patent is difficult to use and requires placement of a harness over the injured person's chest and beneath the armpits which is difficult to perform from the boat, or requires a rescuer to enter the water. The device described in the latter patent is complex and provides for suspending the victim over the water for transport to land. In addition, the structure makes it difficult to administer immediate aid to the victim.

There therefore remains a need to provide apparatus for rescuing persons from the water using small boats which is easy to use, does not require placing a harness on the victim, and provides easy access to the victim for administering first aid during transport to land.

SUMMARY OF THE INVENTION

The above need is satisfied by the present invention which includes a rescue basket having a bottom wall and a side wall substantially at right angles to each other. Roller means mounted to the side wall of the rescue basket adjacent the ends engage guide rails extending downward along the side of the hull of the boat to guide movement of the basket along the guide rails. The guide rails extend downward a distance such that the bottom wall of the basket is submerged when the rollers are adjacent the lower ends of the rails so that the victim may be easily maneuvered into the basket utilizing the buoyancy provided by the water.

Motive means, preferably in the form of cables wound on a winch, raises and lowers the basket along the guide rails. Stop means on the guide rails engage the rollers so that further upward operation of the winch causes the rescue basket to rotate about the rollers to bring the side wall into a horizontal position generally at the level of the top edge of the hull, with the bottom wall extending generally vertically upward. This causes the victim to roll from the bottom wall over onto the side wall where he or she can be more easily attended or moved completely into the boat. The now vertical bottom wall provides a high barrier which prevents the victim from being lost overboard in the event of any rolling or tipping of the boat.

Preferably, the rollers are mounted at the top of the side wall, however, locating the rollers at a lower position on the side wall permits the victim to be transferred further inboard as the basket rotates.

In the preferred form, the stop means on the guide rails include detents in which the rollers engage, and a latch mechanism in the form of spring loaded dogs, which lock the rollers in the detents.

Also preferably, the guide rails extend upward above the top edge of the hull and the lifting cables are reeved over pulleys mounted on these extensions. The preferred embodiment of the invention is also provided with, braces extending laterally out from the extended guide rails to form a seat against which the bottom wall is cinched by the winch to steady the basket in the raised position.

Thus, it is a primary object of the invention to provide an improved rescue device for small boats.

It is another object of the invention to provide such a rescue device which is easy to use and does not require placing a harness around the victim.

It is also an object of the invention to provide such a rescue device which can be submerged, so that the person to be rescued can be at least partially supported by the buoyancy provided by the water while being maneuvered into the device.

It is a further object of the invention to provide such a rescue device which raises the victim to a position where he or she can be attended while in transit, or easily assisted into the boat.

It is still another object of the invention to provide such a device which can be secured in the raised position to form a stable platform for administering aid and transporting the victim to land.

These and other objects of the invention will be fully understood from the following description of the invention with reference to the illustrations appended hereto.

DESCRIPTION OF THE PREFERRED EMBODIMENTS

Figure 1:
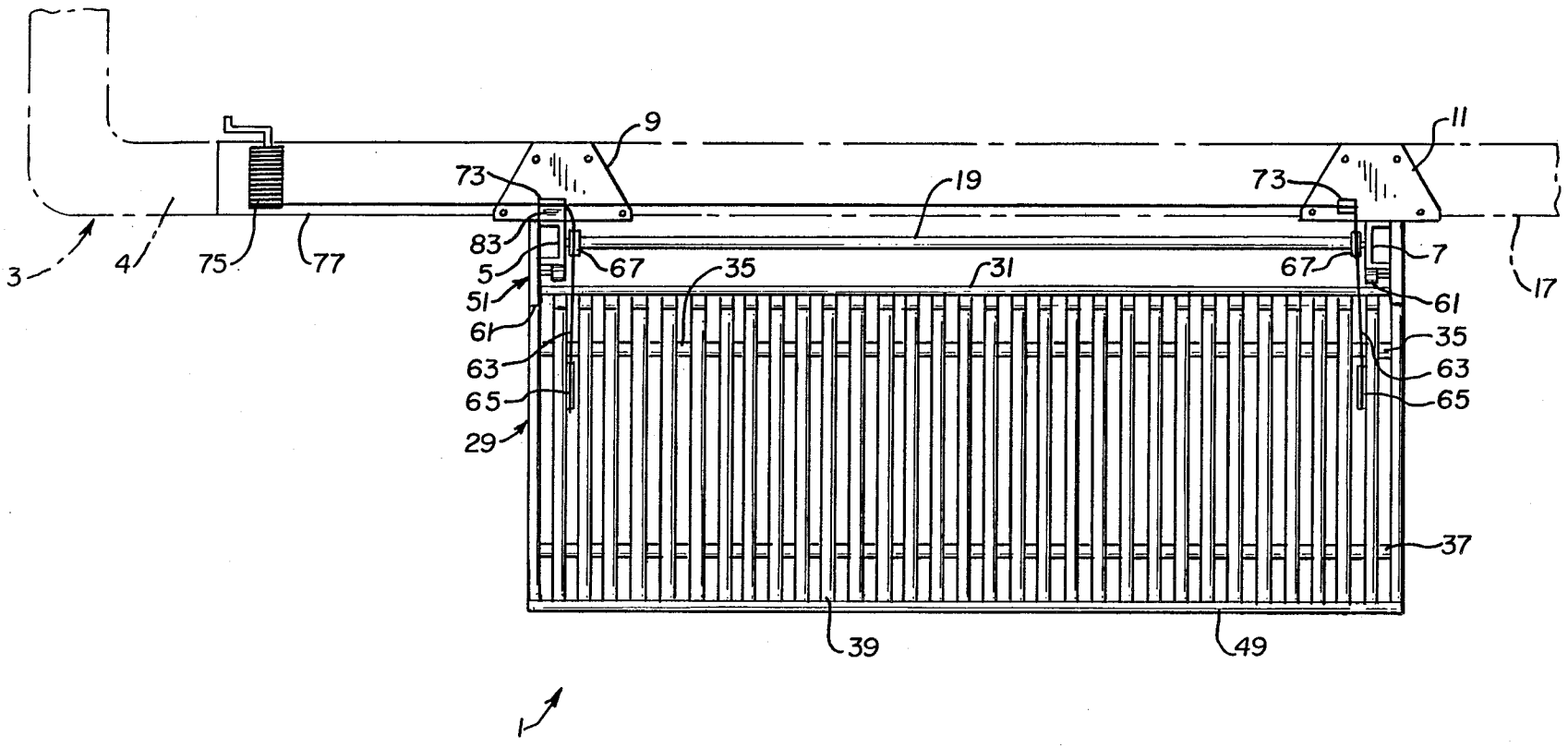
FIG. 1 is a top plan view of rescue apparatus in accordance with the invention mounted on the side of a small boat.
Figure 2:
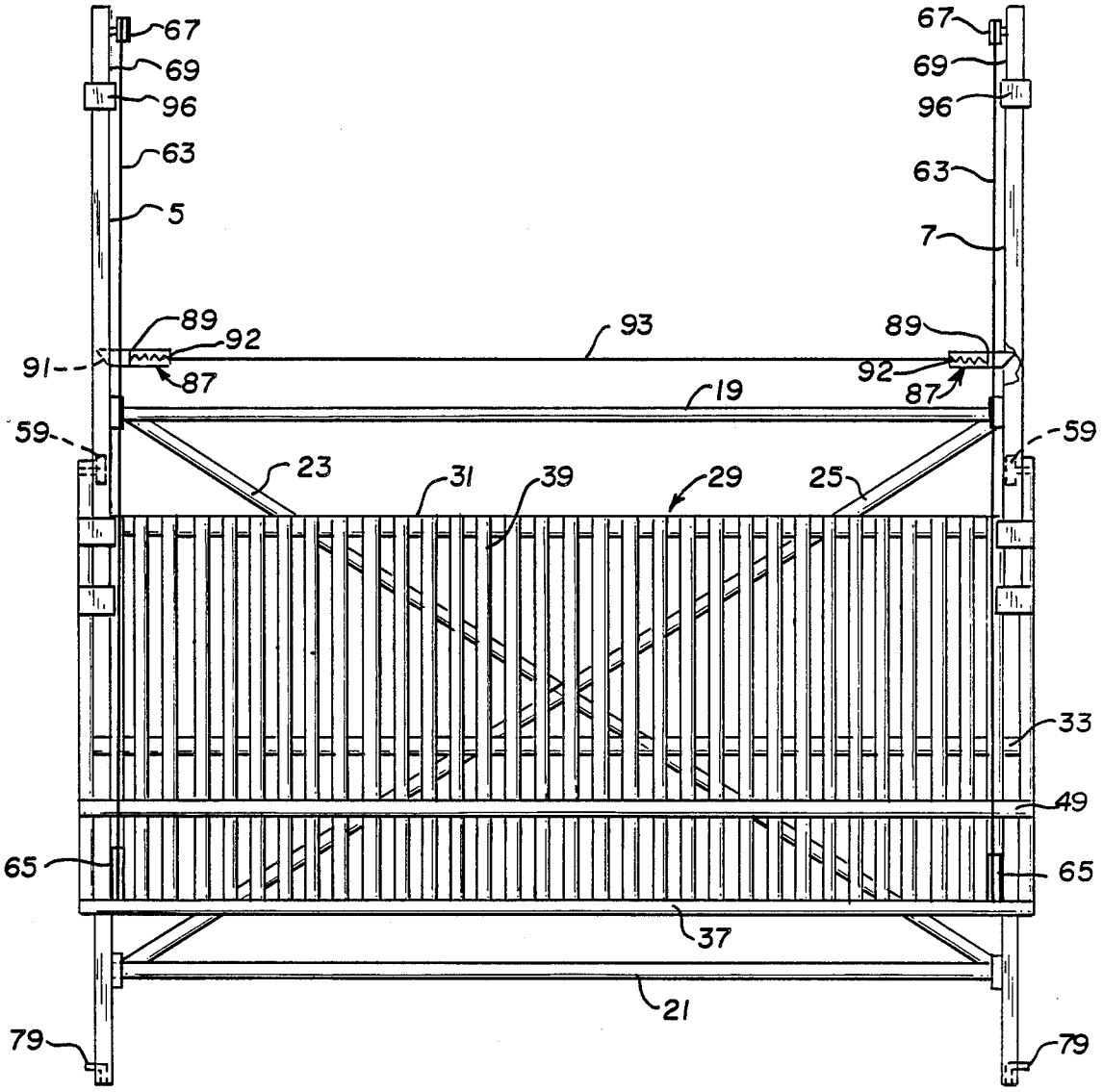
FIG. 2 is a side elevation view of the rescue apparatus of FIG. 1.
Figure 3:
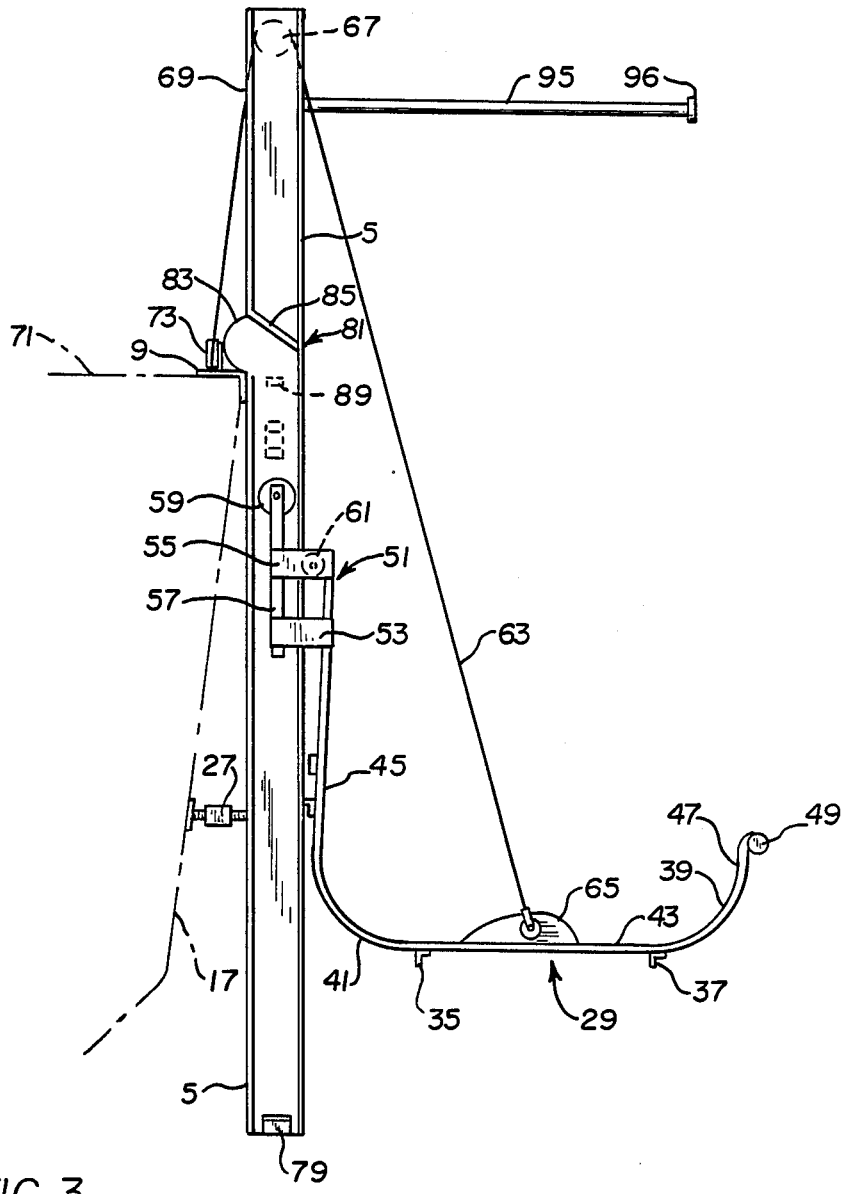
FIG. 3 is an end elevation view of the rescue apparatus illustrated in FIGS. 1 and 2.

The rescue device 1 of the invention is preferably secured to the side of a small boat 3 as shown in FIGS. 1–3. The device may alternatively be secured to the stern of a boat which is not equipped with an outboard motor and is broad enough to accommodate the device, and may even be connected to the squared bow of a boat such as a Boston Whaler.

The rescue device 1 includes a pair of spaced guide rails 5 and 7 in the form of U-shaped channel members which are secured to brackets 9 and 11 mounted on the gunwhales 4 of the boat 3. The brackets 9 and 11 support the guide rails so that they extend generally vertically downward along the hull 17. The guide rails are braced by longitudinal members 19 and 21 and cross members 23 and 25 to provide a rigid structure. Adjustable brackets 27 secured to the lower portion of the guide rails bear against the hull 17 to stabilize the structure.

The rescue device 1 also includes a rescue basket 29. The basket includes longitudinal supports 31, 33, 35 and 37, and transversely extending spaced ribs 39 which are bent about a radius 41 to form a bottom wall 43 and a side wall 45 which are substantially at rights angles to one another. The ribs 39 curve upward from the bottom wall to form an outer raised edge 47 which terminates in a longitudinally extending tubular member 49.

The rescue basket 29 is attached to the guide rails by trolleys 51 connected to each end of the side wall 45. Each of these trolleys 51 includes spaced members 53 and 55 extending laterally from the side wall 45 and a longitudinal member 57 connecting the ends of the members 53 and 55. A first roller 59 rotatably mounted to the longitudinal member 57 engages the channel member 5 or 7 forming the associated guide rail. A second roller 61 mounted to the member 55 bears against the outer surface of the channel member forming the guide rail. These rollers 59 and 61 guide the basket for movement along the guide rails. Vertical spacing between the pulleys 59 and 61 helps stabilize the basket.

The rescue basket 29 is raised and lowered by motive means which include cables 63 connected to brackets 65 at each end of the bottom wall 43 of the basket. The cables 63 are reeved over pulleys 67 rotatably mounted to portions 69 of the guide rails 5 and 7 which extend upward above the top edge 71 of the boat. The cables 63 then pass downward and around pulleys 73 mounted on the brackets 9 and 11, and are led to a winch 75 mounted on a support plate 77 secured to the boat. While a manual winch is shown in the exemplary embodiment of the invention, alternatively a powered winch could be used. In addition, the cables and pulleys 73 could be enclosed by a housing to reduce the possibility of inadvertent contact.

Operation of the winch 75 causes the rescue basket 29 to be raised and lowered on the guide rails 5 and 7. Stops 79 at the lower end of the guide rail engage the lower end of the members 57 of the trolleys 51 to prevent the basket 29 from becoming disengaged from the guide rails at the lower end.

Upward travel of the trolleys 51 carrying the rescue basket 29 is limited by stop means 81 which include lateral detents 83 in the flange of the associated guide rail adjacent the boat, and a deflector plate 85 in the channel which guides the rollers 59 into the detents 83. As the rescue basket is raised, the rollers 59 engage the deflector plates 85 and a force component is generated which urges the rollers into the detents 83. With further upward travel of the roller 59 prevented, continued operation of the winch causes the rescue basket 29 to pivot around the rollers 59 until the side wall 45 becomes horizontal, with the bottom wall 43 extending vertically upward.

The rollers 59 can be locked in the detents 83 by latching devices 87. The latching devices comprise spring biased dogs 89 having beveled surfaces 91 which are engaged by the ascending rollers to push the dogs aside and allow the rollers to pass above the dog and into the detents 83. The dogs are then extended to the locking position by springs 92. A cable 93 connected to the spring biased dogs may be pulled to simultaneously release both of the latch mechanisms so the basket 29 can be lowered.

In the preferred form of the invention, braces 95 extend laterally outward from the extensions 69 of guide rails 5 and 7 to form seats 96 against which the bottom wall 43 of rescue basket 29 may be cinched by the winch 75 to stiffen the structure for transport of the victim to shore.

Figure 4C:
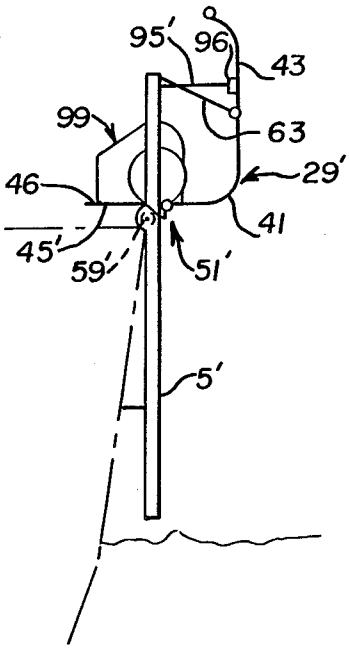
FIG. 4*c* is a simplified end elevation view of a modified form of the rescue apparatus in accordance with the invention shown in the raised and pivoted position.
Figure 4B:
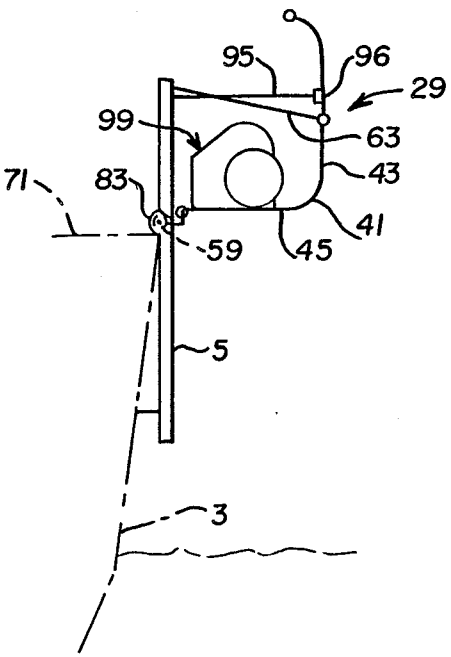
FIG. 4*b* is a view similar to FIG. 4*a* illustrating the rescue basket of the apparatus in the raised and pivoted position.
Figure 4A:
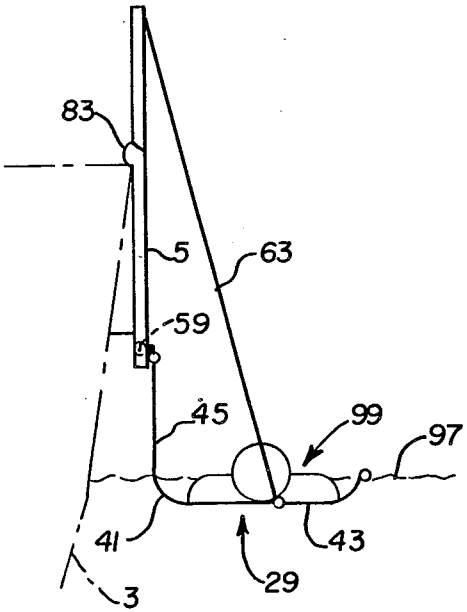
FIG. 4*a* is a simplified end elevation view of the rescue apparatus of FIGS. 1–3 shown in the lowered position.

Operation of the rescue device 1 can be understood by reference to FIGS. 4*a* and *b*. The latch mechanism 87 is released and the winch 75 is operated to lower the basket 29 to the position shown in FIG. 4*a*. The guide rails 5 and 7 extend downwardly towards the water line 97 sufficiently that with the basket 29 in the lowered position, the bottom wall 43 is submerged. This allows the buoyancy provided by the water to be used to maneuver the person 99 to be rescued into the basket 29 and onto the bottom wall 43. The open lattice formed by the ribs 39 permit the basket 29 to be easily submerged and to be raised without adding water to the load.

With the victim 99 in position in the basket 29, the winch 75 is operated to raise the basket along the guide rails 5 and 7. When the roller 59 enters the detent 83 continued operation of the winch 75 rotates the basket 29 to the position shown in FIG. 4*b* where the side wall 45 is generally horizontal and substantially level with the top edge 71 of the boat 3. The bottom wall 43 of the rescue basket 29 is now vertical to form a high barrier which precludes the victim 99 from falling overboard, even if the boat is rolling or tips in that direction.

With the victim 99 in the position shown in FIG. 4*b*, immediate aid can be administered during transport to shore, or if desired, the victim can easily be brought fully into the boat.

As can be seen from FIG. 4*b*, rotation of the basket 29 brings the bottom wall 43 into contact with the seat 96 on brace 95. By continuing to operate the winch 75, the basket 29 can be cinched against this seat 96 to provide a stable support, and the winch 75 can be locked to maintain this condition.

FIG. 4*c* illustrates the operation of an alternative embodiment of the invention in which the trolleys 51' which guide the basket 29' in its movement along the guide rails 5' and 7' are secured to each end of the side wall 45 about midway between the top 46 of the side wall 45 and the bottom wall 43. With this arrangement, rotation of the basket 29' around the roller 59' brings the victim 99 further inboard. This arrangement also requires that the guide rails 5' and 7' (the latter not shown) extend downward further to submerge the basket 29' for pickup of the victim. As can be appreciated, the trolleys can be attached at any desired point along the ends of the side walls 45'.

As shown in FIGS. 4*a–c*, pivoting of the basket 29 rolls the rescued person 99 onto his or her side, however, the side wall 45 is wide enough that, if desired, the victim can be rolled back onto the back. In addition, the large curvature 41 between the side wall and the bottom wall permits the rescued person to remain on his or her back throughout pivoting by pulling the person toward the boat as the basket rotates.

As can be appreciated, the rescue device 1 of the invention can be used to quickly and safely, with minimum effort, bring even an incapacitated person to a position where aid can be administered or even into the boat. The device can be operated by a single person and does not require a harness or entry of a rescuer into the water. For very small boats, it may be desirable to provide additional buoyancy devices 101 such as shown in FIG. 4c, to minimize heeling of the boat when utilizing the rescue device.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be ilustrative only and not limiting as to the scope of the invention which is to be given the full breadth of the appended claims and any and all equivalents thereof.

What is claimed is:

1. Rescue apparatus for a small boat, said apparatus comprising:

a pair of guide rails;

means securing said guide rails in parallel relation extending generally downward along the hull of the boat;

a rescue basket having a bottom wall and a side wall substantially at right angles to each other;

rollers rotatable mounted to the side wall of the rescue basket adjacent the ends thereof and engageable in said guide rails for guiding movement of said basket along said rails, said guide rails extending downward a distance such that the bottom wall of the basket is submerged with the rollers adjacent to the lower ends of said guide rails;

stop means limiting upward travel of said rollers along said guide rails; and motive means raising and lowering said basket along said guide rails and pivoting said basket around said rollers with the rollers engaging said stop means to rotate the side wall of the basket into a generally horizontal position substantially at the level of the top edge of the hull of the boat with the bottom wall extending substantially vertically upward from the side wall.

2. The apparatus of claim 1 wherein said motive means includes a winch, and cable means secured to the bottom wall of said basket at points spaced from the side wall and wound on said winch.

3. The apparatus of claim 2 wherein said guide rails have extended portions extending upward above said stop means, and wherein said motive means includes pulleys rotatably mounted on said extended portions of said guide rails with the cable means reeved over said pulleys between the winch and the bottom wall of the basket.

4. The apparatus of claim 3 including brace means extending laterally outward from the extended portions of the guide rails and against which said basket is cinched as the basket is pivoted with the rollers engaging said stop means.

5. The apparatus of claim 2 including brace means extending laterally outward from said rails and against which said basket is cinched as the basket is pivoted with the rollers engaging the stop means.

6. The apparatus of claim 1 wherein said rollers are rotatably mounted adjacent to the upper edge of the ends of said side wall.

7. The apparatus of claim 1 wherein said rollers are spaced downward from the upper edge of the ends of said side walls of the basket.

8. The apparatus of claim 1 including latch means for securing said rollers in the stop means.

9. The apparatus of claim 8 wherein said guide rails are channel members with the rollers engaged in said channel members, and wherein said latch means comprises dogs moveable between a latch position wherein the dogs extend into said channel members to prevent downward movement of the rollers, and a retracted position wherein the rollers are free to move downward in the channel members and means biasing the dogs to said latched position and retracting the dogs as the basket is raised.

10. The apparatus of claim 1 wherein said stop means includes lateral detents in said tracks which are entered by said rollers, cable means applying a force to the basket having a component which urges said rollers into the detents, and deflecting means which guide the rollers into such detents.

11. The apparatus of claim 10 including latch means which locks the rollers in said detents.

12. The apparatus of claim 1 wherein said bottom wall has a raised outer edge.

13. The apparatus of claim 1 wherein said pair of guide rails comprise oppositely facing channel members, and including adjacent each channel member, a trolley secured to the side wall of the basket, said roller rotatably mounted on the trolley and engageable within the channel member, and an additional roller rotatably mounted on the trolley vertically displaced below the first mentioned roller and bearing against the outer surface of the channel member facing the basket.

14. Rescue apparatus for a small boat comprising:

a pair of guide rails;

means securing said guide rails in spaced parallel relation extending generally downward along the hull of the boat;

a rescue basket having a bottom wall and, a side wall substantially at right angles to the bottom wall, said bottom wall having a raised side edge opposite the side wall;

rollers rotatably mounted to the side wall to the rescue basket adjacent the ends thereof and engageable with said guide rails for guiding movement of said basket along said guide rails, said guide rails extending downward a distance such that the bottom wall of the basket is submerged with the rollers adjacent the lower ends of said rails;

lateral detents in said guide rails which are entered by said rollers and which limit upward travel of said rollers along the guide rails;

latch means which lock the rollers in said detents; and a winch, and cables wound on said winch and connected to the bottom wall of said basket, said winch raising and lowering said basket along said guide rails, and pivoting said basket around the rollers with the rollers locked in the detents to rotate the side wall of the basket into a generally horizontal position substantially at the level of the top edge of the hull of the boat, and with the bottom wall extended substantially vertical upward from the side wall.

* * * * *